US007396597B2

(12) United States Patent
Nishiyama et al.

(10) Patent No.: US 7,396,597 B2
(45) Date of Patent: Jul. 8, 2008

(54) NI-CR-FE ALLOY AND NI-CR-FE ALLOY PIPE HAVING RESISTANCE TO CARBURIZATION AND COKING

(75) Inventors: Yoshitaka Nishiyama, Nishinomiya (JP); Yoshimi Yamadera, Kobe (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 432 days.

(21) Appl. No.: 10/892,237

(22) Filed: Jul. 16, 2004

(65) Prior Publication Data

US 2005/0045251 A1 Mar. 3, 2005

(30) Foreign Application Priority Data

Jul. 17, 2003 (JP) ..... 2003-276038

(51) Int. Cl.
*B32B 15/00* (2006.01)
*B32B 15/04* (2006.01)
*B32B 15/18* (2006.01)
*F16L 9/14* (2006.01)

(52) U.S. Cl. ..... 428/685; 428/336; 428/469; 428/472.1; 428/666; 138/140; 138/141

(58) Field of Classification Search ..... 428/666, 428/667, 685, 336, 448, 450, 34.1, 469, 472, 428/701, 472.1; 138/140, 141, 145, 146
See application file for complete search history.

(56) References Cited

U.S. PATENT DOCUMENTS 3,904,378 A * 9/1975 Higbee et al. ..... 428/684
4,472,223 A 9/1984 Bowsky
5,804,056 A * 9/1998 Pempera et al. ..... 205/661
6,503,347 B1 * 1/2003 Wysiekierski et al. ..... 148/512

FOREIGN PATENT DOCUMENTS

GB 2233672 A 1/1991

(Continued)

OTHER PUBLICATIONS

Database WPI, Section Ch, Week 200217, Derwent Publications, Ltd., London, GB, Class M24, AN 2002-128805, XP002307674, no date.

(Continued)

*Primary Examiner*—Michael La Villa
(74) *Attorney, Agent, or Firm*—Clark & Brody

(57) ABSTRACT

A stainless steel pipe includes a base metal containing 20-35 mass % of Cr, and a Cr-depleted zone is formed in the surface region of the pipe. The Cr concentration in the Cr-depleted zone is at least 10%, and the thickness of the Cr-depleted zone is at most 20 micrometers. A Cr-based oxide scale layer having a Cr content of at least 50% and a thickness of 0.1-15 micrometers may be provided on the outer side of the Cr-depleted zone. An Si-based oxide scale layer with an Si content of at least 50% may be provided between the Cr-based oxide scale layer and the Cr-depleted zone. The pipe is particularly suitable for use in petroleum refineries or petrochemical plants, such as for use as a pipe of a cracking furnace of an ethylene plant.

12 Claims, 3 Drawing Sheets

FOREIGN PATENT DOCUMENTS

| | | |
|---|---|---|
| JP | 53-66832 | 6/1978 |
| JP | 53-66835 | 6/1978 |
| JP | 57-023050 | 2/1982 |
| JP | 57-043989 | 3/1982 |
| JP | 02-008336 | 1/1990 |
| JP | 09291342 | 11/1997 |
| JP | 11-029776 | 2/1999 |
| JP | 2000-509105 | 7/2000 |

OTHER PUBLICATIONS

Database WPI, Section Ch, Week 200378, Derwent Publications, Ltd., London, GB, Class M24, AN 2003-840606, XP002307675, no date.

"The Relation between Carburization Resistance and Surface Oxide Film of Heat Resistant Steels for Petro-chemical Plants" by Kunihiko Yoshikawa, et al.; *The Sumitomo Search*, No. 33, Nov. 1986.

* cited by examiner

NI-CR-FE ALLOY AND NI-CR-FE ALLOY PIPE HAVING RESISTANCE TO CARBURIZATION AND COKING

BACKGROUND OF THE INVENTION

This invention relates to a stainless steel having excellent high temperature strength and corrosion resistance and having a scale layer with an excellent ability to shield the steel against carburizing gas. The steel is highly suitable for use in manufacturing a steel pipe or tube (hereafter referred to as "pipe" collectively) capable of being used in a carburizing gas atmosphere containing hydrocarbon gas or CO gas, such as a steel pipe for a cracking furnace, a reforming furnace, a heating furnace, or a heat exchanger employed in a petroleum refinery or a petrochemical plant. The present invention also relates to a stainless steel pipe made from this material.

The present invention also relates to a method of manufacturing a stainless steel having excellent resistance to carburization and coking when used in a carburizing gas atmosphere.

In recent years, due to an increasing demand for synthetic resins, there has been a trend towards the use of higher operating temperatures in cracking furnaces in ethylene manufacturing plants, for example, so as to obtain a higher yield of ethylene. As a result, pipes for use in cracking furnaces are being subjected to higher operating temperatures. The inner surface of pipes used in cracking furnaces are exposed to a carburizing atmosphere at high temperatures, so the pipes need to be made of a heat resistant material having excellent high temperature strength and resistance to carburization.

During operation of a cracking furnace, carbon is deposited on the inner surface of the pipes of the cracking furnace (a phenomenon referred to as coking). As the amount of deposited material increases, operational problems can occur such as an increase in pressure losses ($\Delta P$) and a decrease in heating efficiency. Accordingly, so-called decoking in which the deposited carbon is oxidized and removed using air or steam is periodically carried out. However, it is necessary to stop the operation of a cracking furnace in order to perform decoking, so the operating efficiency of the furnace is greatly decreased by the need to carry out decoking. The problem of coking becomes worse as the diameter of the pipes of a cracking furnace decreases. This is a major drawback, because smaller diameter pipes are advantageous from the standpoint of increasing product yield.

In the past, there have been various proposals of materials for suppressing coking. For example, Japanese Published Unexamined Patent Application Hei 2-8336 proposes a steel pipe which includes at least 28% of Cr so as to form a strong and stable $Cr_2O_3$ film on the surface of the pipe to prevent Fe and Ni, which act as catalysts to promote carbon deposition, from floating to the surface of the pipe and to thereby suppress coking.

As disclosed in Japanese Published Unexamined Patent Application Sho 57-23050, for example, it is known that increasing the Si content of an alloy so as to form an $SiO_2$ film on the surface of the alloy is effective at increasing resistance to carburization.

However, in the above-described prior art in which the Cr or Si content of a steel is increased in order to form a film of $Cr_2O_3$ or $SiO_2$ on the steel, depending on the operating conditions in an actual carburizing environment, a nonuniform scale layer is formed on the steel surface. If the scale layer undergoes cracking or peeling, it is often not possible for the scale layer to be adequately restored (regenerated).

As a result, the scale layer does not have a satisfactory shielding ability with respect to carburizing gas, so the problem of needing to interrupt equipment operation in order to perform decoking and the problem of deterioration of materials due to carburization remain.

In order to solve these problems of nonuniform formation of scale and inability of a scale to be regenerated, methods have been proposed in which oxidation pretreatment is performed on a steel. For example, Japanese Published Unexamined Patent Applications Sho 53-66832 and Sho 53-66835 disclose a method in which pretreatment of oxidation is carried out on a 25Cr-20Ni (HK 40) low-Si heat resistant steel or a 25Cr-35Ni low-Si heat resistant steel at around 1000° C. in air for at least 100 hours, and Japanese Published Unexamined Patent Application Sho 57-43989 discloses a method in which pretreatment of oxidation in air is carried out on an austenitic heat resistant steel containing 20-35% Cr. In addition, Japanese Published Unexamined Patent Application Hei 11-29776 discloses a method in which resistance to carburization is increased by heating a high Ni—Cr alloy in a vacuum and forming a scale film.

In addition, PCT-based Japanese Published Unexamined Patent Application 2000-509105 discloses a method of increasing resistance to carburization by performing surface treatment to form a layer with an increased concentration of Si or Cr.

However, in any of the above-described prior art methods, it is necessary to carry out special heat treatment or surface treatment, so these methods are uneconomical. In addition, these methods do not take into consideration restoration of scale (scale regeneration) when previously oxidized scale or a surface treatment layer peels off, so localized damage of scale is a problem.

SUMMARY OF THE INVENTION

This invention provides a stainless steel having excellent resistance to carburization and resistance to coking due to having the ability to form and regenerate a scale layer which shields against carburizing gases, such as that found in pipes or tubes of a cracking furnace for an ethylene plant. It also provides a pipe or tube made of such a stainless steel and a method of manufacturing such as stainless steel and pipe.

The present inventors analyzed the surface condition of various stainless steel pipes to investigate the cause of localized carburization and coking, even in steel pipes having a high Cr content. It was found that the surface region of a steel pipe has a Cr-depleted zone having a lower Cr concentration than the base metal of the pipe.

FIG. 1 is a schematic cross-sectional view of the surface region of a steel material having a Cr-based oxide scale layer on its surface, showing the Cr concentration in the steel as a function of the depth from the surface.

From this figure, it can be seen that a Cr-depleted zone is present beneath the Cr-based oxide scale layer. The Cr-depleted zone extends from the inner side of the oxide scale layer to where the Cr content returns to the Cr content of the base metal.

As a result of further investigations, it was found that the Cr-depleted zone is formed by heat treatment carried out during the manufacture of a pipe. The heat treatment causes the formation of an oxide scale layer on the surface of a pipe, and the Cr-depleted zone is formed simultaneously with and immediately beneath the oxide scale layer.

FIG. 2 is a schematic cross-sectional view of the surface region of the steel material of FIG. 1 showing the Cr concentration in the surface layer when the oxide scale layer has been removed.

From in the past, it has been known that if an oxide scale layer is formed on the surface of steel by heating, a Cr-depleted zone is formed immediately beneath it. However, up to now it has been thought that if the oxide scale layer is removed by shot blasting or pickling treatment after heat treatment, the Cr-depleted zone will also be removed. However, the present inventors found that even after shot blasting or pickling treatment, there are cases in which a Cr-depleted zone remains in the surface region of a steel member.

FIG. 3 is a schematic cross-sectional view showing the Cr concentration in the surface region of a steel material having an Si-based oxide scale layer on the inner side of the Cr-based oxide scale layer of FIG. 1. It was found that in this case as well in which an Si-based oxide scale layer is formed, due to the formation of a Cr-based oxide scale layer as an outer layer, a Cr-depleted zone having a reduced concentration of Cr is present.

The present inventors carried out corrosion tests in a carburizing environment using various steel pipes having such a Cr-depleted zone. They found that in some locations a Cr-based oxide scale layer cannot be formed, but that an oxide scale layer containing Fe, Mn, Cr, and the like is formed, and that resistance to carburization and resistance to coking are decreased. In the past, the reason why carburization and coking locally occurred during the initial period of plant operation was unclear, but the present inventors found that the presence of a Cr-depleted zone in the surface of a steel pipe is a primary cause.

Even with a steel pipe on which a Cr-based oxide scale layer is formed previous to the use thereof, there are cases in which localized carburization and coking occur. As a result of detailed observation and analysis, it was found that carburization and coking occur in locations where the previously formed oxide scale layer peels off. Namely, if the Cr-based oxide scale layer peels off, the surface of the steel on which a Cr-depleted zone is exposed, so if a new Cr-based oxide scale layer cannot be formed, corrosion in the form of carburization and coking occurs.

If a Cr-depleted zone is present on the surface of steel, a Cr-based oxide scale layer is nonuniformly formed during the initial period of plant operation. Even if a Cr-based oxide scale layer is previously formed on the pipe during manufacturing, when the oxide scale layer is damaged, the Cr-depleted zone is exposed to the environment to impede regeneration of the Cr-based oxide scale layer. In this manner, the presence of such a Cr-depleted zone causes corrosion in the form of localized carburization and coking.

Thus, the present inventors found that in order to achieve a significant increase in resistance to carburization and coking, it is important to control the characteristics of the Cr-depleted zone.

In order to analyze the relationship between the Cr concentration of a Cr-depleted zone in the surface region of a steel pipe and the occurrence of carburization, test pieces (20 mm wide by 30 mm long) were cut from steel members having Cr-depleted zones with different Cr concentrations. The test pieces were held for 300 hours at 1000° C. in a gas atmosphere containing, in volume percent, 15% $CH_4$-3% $CO_2$-82% $H_2$ to simulate a carburizing gas atmosphere. It was found that if the Cr concentration in the Cr-depleted zone is less than 10%, there is an increase in the amount of penetration of C.

In the present invention, the Cr concentration in the Cr-depleted zone means the average Cr concentration in the Cr-depleted zone. More specifically, the Cr concentration in the Cr-depleted zone is the one measured with EPMA(Electron Probe Micro Analysis).

FIG. 4 is a graph showing the relationship between the Cr concentration in a Cr-depleted zone and the amount of penetration of C. Here, test pieces with a Cr-depleted zone having a depth, i.e., a thickness of 5-15 micrometers from the surface of the test pieces were used. It can be seen that when the Cr concentration of the Cr-depleted zone is larger than a prescribed value a particularly marked effect on preventing carburization can be achieved.

Based on microscopic observation of a cross section of a test piece after the test, it was found that when the Cr concentration of the Cr-depleted zone is less than 10%, a Cr-based oxide scale layer cannot be formed. In order to form a Cr-based oxide scale layer, it is necessary to supply Cr from the base metal by diffusion, but if a Cr-depleted zone is present, the supply of Cr becomes inadequate. As a result, instead of a Cr-based oxide scale layer, an oxide scale layer containing Fe, Mn, Ni, Cr, or the like is formed, but an oxide scale layer containing Fe, Mn, Ni, Cr, or the like has a low denseness, so its ability to shield against carburizing gas is poor. In addition, if the Fe in the oxide scale layer is reduced and becomes metallic Fe, due to its catalyzing effect, coking is enormously accelerated.

In order to determine the influence of the thickness of the Cr-depleted zone, a carburizing test was carried out (the test conditions were the same as in the case of FIG. 4). It was ascertained that if the thickness of the Cr-depleted zone exceeds a prescribed value, there is a tendency for the amount of C which penetrates to increase.

FIG. 5 is a graph showing the relationship between the thickness, i.e., depth (micrometers) of a Cr-depleted zone and the amount of penetrated C. It uses test pieces in which the Cr concentration of the Cr-depleted zone is 15-25 mass percent.

From this figure, it can be seen that if the thickness of the Cr-depleted zone exceeds 20 micrometers, the amount of penetrated C abruptly increases.

The reason for this abrupt increase is thought to be that if the thickness exceeds a certain level, the amount of Cr supplied from the base metal is not sufficient to form a Cr-based oxide scale layer on the surface of the steel having the ability to shield against carburizing gas during plant operation.

Next, analysis of a Cr-based oxide scale layer was carried out using a steel pipe on the surface of which a Cr-based oxide scale layer (A) was previously formed. It was found by experiment that if the Cr content in the oxide scale layer is at least 50% and preferably at least 80%, carburization is suppressed.

FIG. 6 is a graph showing the relationship between the Cr concentration in the oxide scale layer and the amount of C which penetrates.

This figure was obtained using test pieces in which the Cr concentration of the Cr-depleted zone was 15-25 mass percent, the thickness of the Cr-depleted zone was approximately 10 micrometers, and the thickness of the oxide scale layer on the surface of the test pieces was 2-7 micrometers.

As shown in FIG. 6, if the Cr concentration in the scale layer is greater than or equal to 50%, there is an abrupt decrease in the amount of penetrated C. In addition, from microscopic observation of cross sections of test pieces after the test, it was observed that the oxide scale layer is dense, so it is thought that it has excellent ability to shield against carburizing gas. In addition, it became clear that it is difficult for cracking and peeling of the oxide scale layer to occur.

It was found that the thickness of a Cr-based oxide scale layer has an influence on the shielding abilities and on damage such as cracking and peeling. Namely, if the thickness of the Cr-based oxide scale layer is small, the shielding properties are not sufficient, while if the scale thickness is too great, it becomes easy for damage such as cracking and peeling to occur. This is thought to be because as the thickness of the scale layer increases, growth stress in the oxide scale layer increases, and cracking and peeling occur in order to alleviate this stress.

The present inventors found that by forming an Si-based oxide scale layer (B) in the interface between the Cr-based oxide scale layer (A) and the stainless steel base metal, not only is the uniform formation of the oxide scale layer (A) in the initial period of operation promoted, but when damage such as cracking and peeling of the oxide scale layer (A) occurs, the Si-based oxide scale layer (B) promotes regeneration of damaged portions of oxide scale layer (A). However, even when such an Si-based oxide scale layer (B) is present, unless the Cr concentration and the thickness of the Cr-depleted zone are appropriate, localized corrosion occurs.

According to one form of the present invention, a stainless steel for use in a carburizing atmosphere has a base metal containing 20-55 mass % of Cr. The steel includes a Cr-depleted zone in its surface region. The Cr-depleted zone has a Cr concentration of at least 10% and a thickness of at most 20 micrometers.

The stainless steel may further include a Cr-based oxide scale layer with a Cr content of at least 50% formed on the outer side of the Cr-depleted zone.

The oxide scale layer will typically have a thickness of 0.1-15 micrometers.

The stainless steel may further include an Si-based oxide scale layer with an Si content of at least 50% between the Cr-based oxide scale layer and the Cr-depleted zone.

The base metal preferably has a chemical composition comprising, in mass percent, C: 0.01-0.6%, Si: 0.1-5%, Mn: 0.1-10%, P: at most 0.08%, S: at most 0.05%, Cr: 20-55%, Ni: 20-70%, N: 0.001-0.25%, O: oxygen: at most 0.02%, and a remainder of Fe and impurities.

The base metal may further comprise, in mass percent, at least one material selected from the following (i)-(viii):

(i) Cu: 0.01-5%, (ii) Co: 0.01-5%

(iii) At least one of Mo: 0.01-3%, W: 0.01-6%, Ta: 0.01-6%, Re: 0.01-6%, and Ir: 0.01-6%

(iv) At least one of Ti: 0.01-1% and Nb: 0.01-2%

(v) At least one of B: 0.001-0.1%, Zr: 0.001-0.1%, and Hf: 0.001-0.5%

(vi) At least one of Mg: 0.0005-0.1%, Ca: 0.0005-0.1%, and Al: 0.01-1%

(vii) At least one of Y: 0.0005-0.15%, and Ln series elements: 0.0005-0.15%

(viii) At least one of Pd: 0.005-1%, Ag: 0.005-1%, Pt: 0.005-1%, and Au: 0.005-1%

According to another form of the present invention, a stainless steel pipe comprises the above-described stainless steel and has a plurality of fins and bosses on its inner surface.

According to yet another form of the present invention, a method of improving resistance to carburization and coking of a stainless steel pipe for use in a carburizing gas atmosphere employs a pipe with a base metal including 20-55 mass % of Cr. The method includes providing a Cr-depleted zone in the surface region of the steel pipe. The Cr concentration of the Cr-depleted zone is at least 10%, and the thickness of the Cr-depleted zone at most 20 micrometers.

A Cr-based oxide scale layer having a Cr content of at least 50% may be provided on the outer side of the Cr-depleted zone, with the thickness of the oxide scale layer preferably being 0.1-15 micrometers.

DESCRIPTION OF PREFERRED EMBODIMENTS

Figure 1:
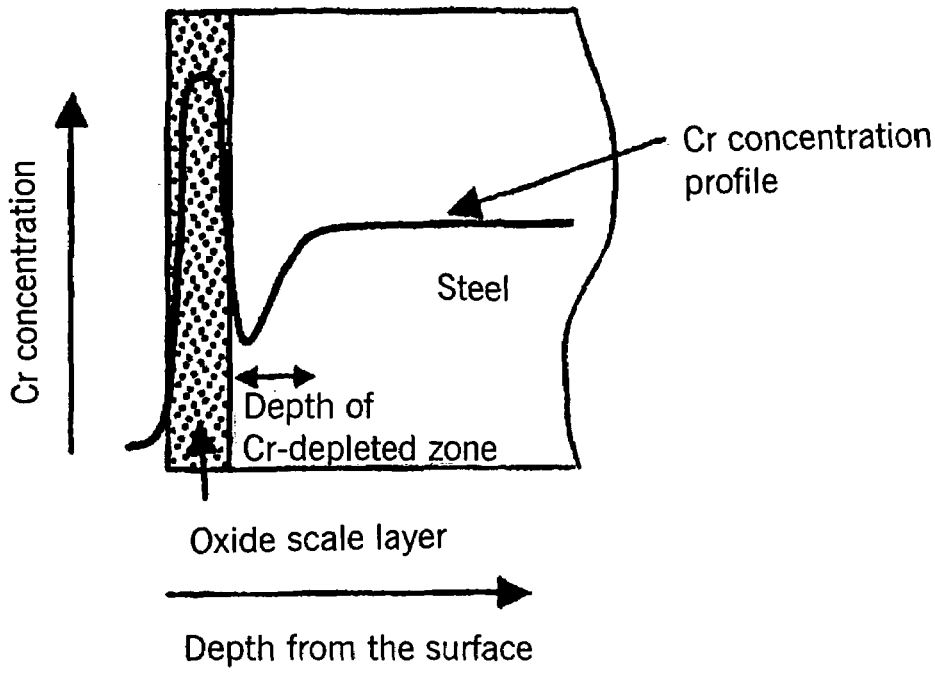
FIG. 1 is a schematic cross-sectional view of the surface region of a steel material having a Cr-based oxide scale layer on the surface, showing the Cr concentration of the steel as a function of depth from the surface of the steel.
Figure 2:
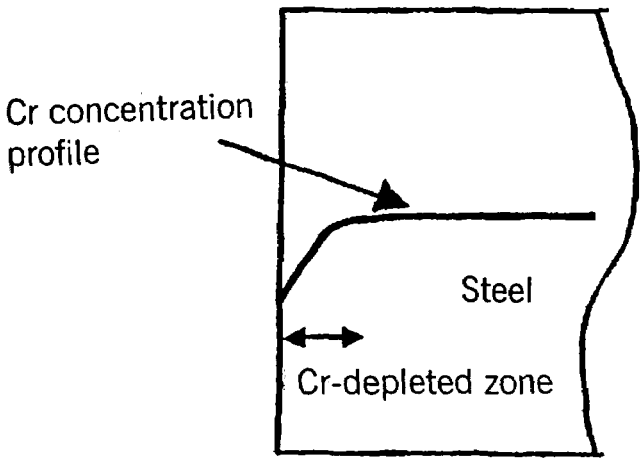
FIG. 2 is a schematic cross-sectional view of the surface region of the steel material of FIG. 1 showing the Cr concentration in the surface region when the oxide scale layer of FIG. 1 has been removed.
Figure 3:
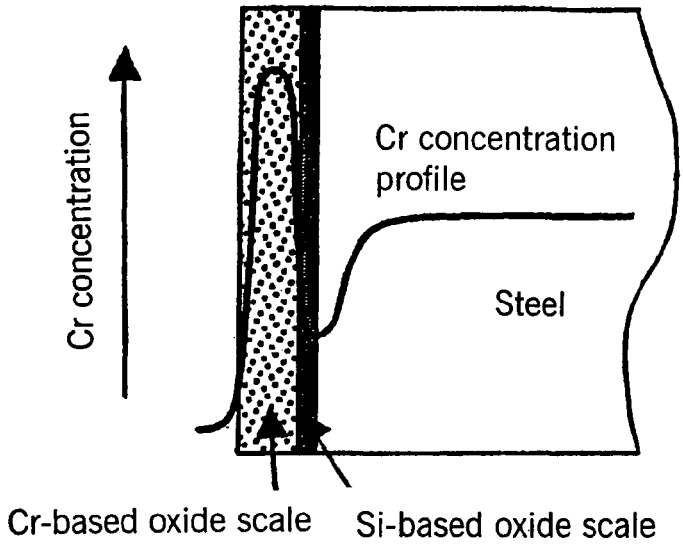
FIG. 3 is a schematic cross-sectional view of the surface region of a steel material having an Si-based oxide scale layer on the inner side of the Cr-based oxide scale layer of FIG. 1, showing the Cr concentration in the surface region.
Figure 4:
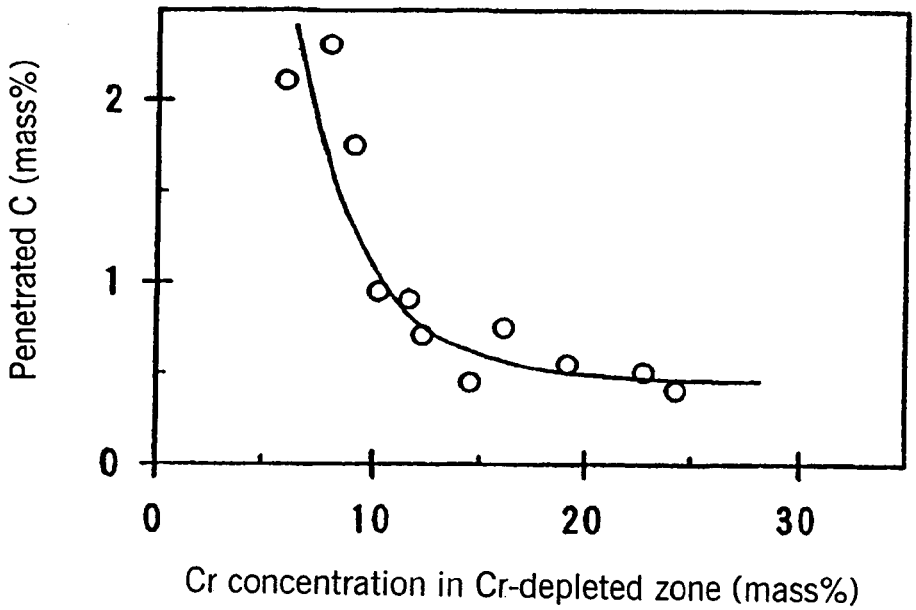
FIG. 4 is a graph of the relationship between the Cr concentration of a Cr-depleted zone and the increase of C content.
Figure 5:
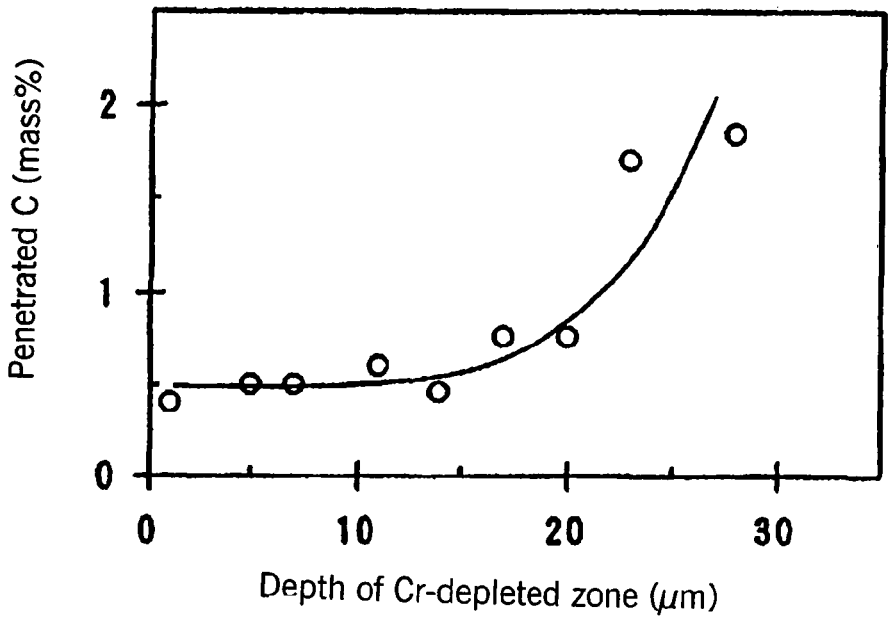
FIG. 5 is a graph of the relationship between the depth of a Cr-depleted zone and the increase of C content.
Figure 6:
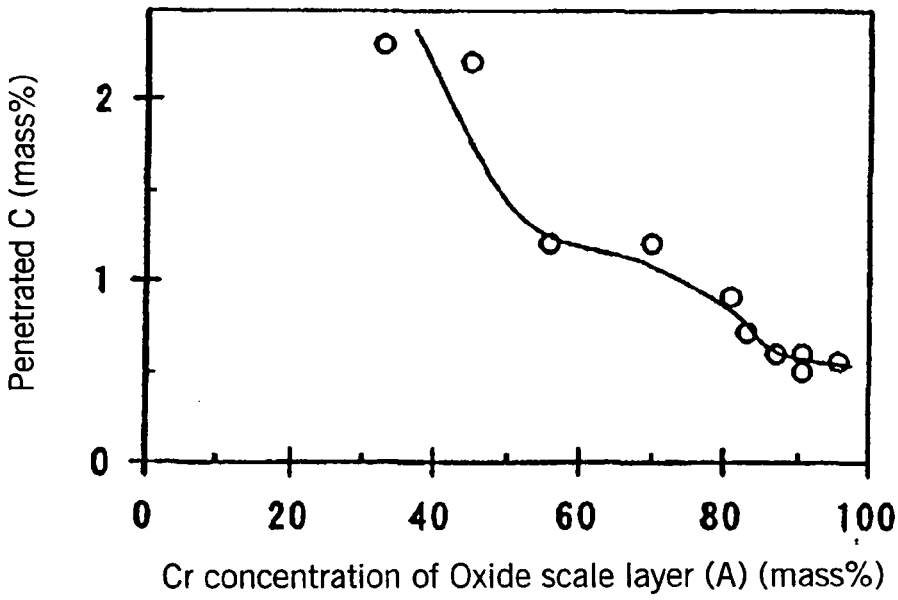
FIG. 6 is a graph of the relationship between the Cr concentration of an oxide scale layer and the increase of C content.

Next, the reasons for the ranges of various parameters of the present invention will be explained. In the following explanation, unless otherwise indicated, percent when used to describe chemical composition refers to mass percent.

A stainless steel according to the present invention comprises a base metal including 20-55% Cr and preferably 20-35% Cr. A stainless steel comprising 20-35% Cr is suitable for use in manufacturing pipes for ethylene manufacture (ethylene cracking tubes).

(i) Cr-depleted Zone

Cr concentration of the Cr-depleted zone: The Cr-depleted zone is formed immediately below the oxide scale layer which is formed during homogenizing heat treatment of a stainless steel according to the present invention. The Cr concentration of this Cr-depleted zone is lower than the Cr concentration of the base metal, but if it is less than 10%, a Cr-based oxide scale layer having the ability to shield against carburizing gas during plant operation cannot be formed on the surface of the steel. When a Cr-based oxide scale layer already exists on the steel surface prior to the use thereof, if the Cr concentration of the Cr-depleted zone immediately beneath it is less than 10%, the Cr-based oxide scale layer cannot be regenerated if it undergoes damage such as cracking or peeling. Preferably the Cr concentration of the Cr-depleted zone is at least 12%.

Thickness of the Cr-depleted zone: The Cr-depleted zone is formed immediately below the oxide scale layer which is formed during homogenizing heat treatment. If the thickness of the Cr-depleted zone exceeds 20 micrometers, it is difficult to form a Cr-based oxide scale layer on its surface which has the ability to shield against carburizing gas during plant operation. Therefore, the thickness of the Cr-depleted zone is made at most 20 micrometers. Preferably the thickness is at most 15 micrometers.

The thickness of the Cr-depleted zone can be easily adjusted by heat treatment in a controlled atmosphere, for example.

The Cr concentration and thickness of the Cr-depleted zone can be measured with EPMA. A specimen for EPMA can be prepared by cutting a specimen with a microscopic cross section, polishing it with emery paper, buffing with alumina powder, and performing degreasing. In EPMA, vapor deposition of C is typically performed on the surface of a specimen, and the Cr concentration in the depth direction is measured while moving the probe at the rate of 2-400 micrometers a minute. In the measurement with EPMA, acceleration voltage is at 10-25 KeV (preferably 15-20 KeV) and electric current at 5-30 nA (preferably 5-20 nA).

(ii) Oxide Scale Layer

Composition of Oxide Scale Layer (A):

The Cr-based oxide scale layer is extremely important for providing resistance to carburization and coking. A Cr-based oxide scale layer with a Cr content of at least 50% has a high denseness and good ability to shield against penetration of carbon into steel. In addition, a Cr-based oxide scale layer has a small catalyzing effect with respect to coking, so it suppresses coking of the steel surface. As a result, it maintains the thermal conductivity of the pipe with respect to fluids inside it for long periods, and the yield of reaction products such as olefins is stabilized.

If the Cr content of the oxide scale layer is at least 80%, the scale layer becomes denser, and a shielding layer which has good resistance to penetration of carbon into steel is obtained. As a result, resistance to carburization is dramatically increased. A more preferred Cr content is at least 82%, and a still more preferred Cr content is at least 85%.

Thickness of Oxide Scale Layer (A):

The thickness of the Cr-based oxide scale layer is an important factor affecting penetration of carbon into steel. The effect of the Cr-based oxide scale layer as a shielding layer is small if its thickness is less than 0.1 micrometer. On the other hand, if its thickness exceeds 15 micrometers, growth stress and thermal stress at the time of cooling accumulate, and cracking and peeling of the oxide scale layer occur, so it becomes easy for carbon to penetrate the steel. Therefore, the thickness of oxide scale layer (A) is preferably 0.1-15 micrometers. In order to obtain shielding properties with greater certainty, the thickness of oxide scale layer (A) is preferably 0.5-15 micrometers and most preferably 0.5-10 micrometers.

The formation of such an oxide scale layer can easily be achieved by, for example, heat treatment in an atmosphere of a controlled combustion gas.

Oxide Scale Layer (B):

An Si-based oxide scale layer (B) having an Si content of at least 50% may be formed between the Cr-depleted zone and the Cr-based oxide scale layer (A). Oxide scale layer (B) promotes the uniform formation of oxide scale layer (A), and in addition, when there is damage of oxide scale layer (A) such as cracking and peeling, oxide scale layer (B) promotes regeneration of the damaged portion.

Oxide scale layer (B) can be easily formed by increasing the Si content of the base metal steel.

The chemical composition of oxide scale layer (A) and oxide scale layer (B) can be measured by EDX (Energy Dispersive X-ray spectrometry). A test specimen can be prepared by the above-described procedure, for example. In EDX, vapor deposition of C is typically performed on the surface of the test specimen, and then quantitative elemental analysis is performed. The thickness of oxide scale layer (B) can be measured by observing a microscopic sample of a cross section with on optical microscope.

The inner surface of a steel pipe according to the present invention may have surface irregularities, such as bosses or fins for increasing the surface area. Here, surface irregularities refer to departures of the shape of the inner surface of the pipe from a perfectly cylindrical shape which are significantly larger than the surface roughness of the inner surface of the pipe. Bosses, fins, or other surface irregularities may be integrally formed with the pipe body, or they may be attached to the inner surface by welding or other method. The surface irregularities may be randomly arranged on the inner surface, or they may be arranged in a regular pattern. Normally, it is thought that the provision of surface irregularities on a surface makes it easier for an oxide scale layer to be damaged by carburizing gas and undergo peeling. However, according to the present invention, because the resistance to carburization of the inner surface of the steel pipe is high and the oxide scale layer has a good ability of self-healing, the provision of surface irregularities does not in any way reduce the resistance to carburization and coking of the steel pipe.

A stainless steel having the following composition is preferred as the base metal of the steel according to the present invention. The reasons for the limits on the chemical composition of the base metal of the stainless steel are as follows.

C: 0.01-0.6%

At least 0.01% of C is included in the steel according to the present invention in order to guarantee high temperature strength. If the C content exceeds 0.6%, the toughness of the stainless steel becomes extremely poor, so the upper limit is made 0.6%. Preferably the C content is 0.02%-0.45% and more preferably 0.02-0.3%.

Si: 0.1-5%

Si has a strong affinity for oxygen, so it promotes uniform formation of a Cr-based oxide scale layer (A). This effect is exhibited if the Si content is at least 0.1%. However, if the Si content exceeds 5%, weldability worsens and the microstructural stability worsens, so the upper limit of the Si content is made 5%. A preferred range for the Si content is 0.1-3%, and a more preferred range is 0.3-2%.

Mn: 0.1-10%

Mn is added order for the purposes of deoxidizing and improving workability. For these purposes, at least 0.1% is added. Mn is an austenite forming element, so it is possible to replace a portion of Ni with Mn, but addition of too much Mn impedes the formation of a Cr-based oxide scale layer, so the upper limit on the Mn content is made 10%. A preferred range for Mn is 0.1-5% and a more preferred range is 0.1-2%.

P: At most 0.08%, S: at most 0.05%

P and S segregate at grain boundaries and worsen hot workability. Therefore, they are preferably reduced as much as possible, but an excessive decrease leads to an increase in costs, so the P content is made at most 0.08%, and the S content is made at most 0.05%. The P content is preferably at most 0.05% and more preferably at most 0.04%, and the S content is preferably at most 0.03% and more preferably at most 0.015%.

Cr: 20-55%

Cr is an important element in the present invention. It is necessary for the Cr content to be at least 20% in order to stably form a Cr-based oxide scale layer. However, addition of too much Cr decreases pipe manufacturability and decrease the microstructural stability during use of a pipe at high temperatures, so the upper limit on the Cr content is made 55%. In order to prevent a deterioration in workability and stability of metallurgical structure, the upper limit on the Cr content is preferably 35%. A more preferred range is 22-33%.

Ni: 20-70%

The addition of Ni is necessary in order to obtain a stabilized austenite structure containing Cr. For this purpose, the Ni content needs to be 20-70%. Another benefit of the addition of Ni is that it reduces the speed of penetration of C into the steel. However, addition of more Ni than is necessary leads to cost increases and difficulty in manufacturing. A preferred range for the Ni content is 20-60%, and a more preferred range is 23-50%.

N: 0.001-0.25%

N is effective at improving high temperature strength. It is necessary for the N content to be at least 0.001% in order to obtain this effect. Addition of too much N greatly impairs workability, so the upper limit on the N content is made 0.25%. Preferably the N content is 0.001%-0.2%.

Oxygen (O): at most 0.02%

Oxygen (O) is present in a steel according to the present invention as an impurity. If the oxygen content exceeds 0.02%, a large amount of oxide inclusions are present in the steel, so workability is decreased, and in addition, surface defects may occur in the steel pipe, so the upper limit on the oxygen content is made 0.02%.

The following elements may also be added to a steel according to the present invention.

Cu: 0.01-5%

Cu stabilizes an austenite phase, and it is effective for increasing high temperature strength, so at least 0.01% may be added. On the other hand, if it is added in excess of 5%, hot workability is markedly decreased, so the Cu content is made 0.01-5%. A preferred range for the Cu content is 0.01-3%.

Co: 0.01-5%

Co stabilizes an austenite phase, so it can replace a portion of Ni. If Co is added in excess of 5%, hot workability is markedly decreased, so it is made 0.01-5%. A preferred range for the Co content is 0.01-3%.

At least one of Mo: 0.01-3%, W: 0.01-6%, Ta: 0.01-6%, Re: 0.01-6%, and Ir: 0.01-6%.

Each of Mo, W, Ta, Re, and Ir is a solid solution strengthening element and is effective for increasing high temperature strength. In order to obtain these effects, it is necessary to add at least 0.01% each of any of these which is added. However, excessive addition deteriorates workability and impairs the stability of the metallurgical structure, so the upper limit for the content of Mo is at most 3%, and the upper limit for the content of W, Ta, Re, and Ir is at most 6%. The preferred range for any of Mo, W, Ta, Re, and Ir which is added is 0.01-2.5%, and a more preferred range is 0.01-2%.

At least one of Ti: 0.01-1% and Nb: 0.01-2%

Ti and Nb have a significant effect on improving high temperature strength, ductility, and toughness even when added in minute amounts. However, neither of these elements can provide these effects if the content of either of these which is added is less than 0.01%, while workability and weldability decrease if the Ti content exceeds 1% or the Nb content exceeds 2%.

At least one of B: 0.001-0.1%, Zr: 0.001-0.1%, and Hf: 0.001-0.5%

Each of B, Zr, and Hf is effective at strengthening of grain boundaries and improving hot workability and high temperature strength. However, these effects are not obtained with less than 0.001% each of any of these which is added, while excessive addition decreases weldability, so the range for each of these elements which is added is 0.001-0.1%, 0.001-0.1%, and 0.001-0.5%, respectively.

At least one of Mg: 0.0005-0.1%, Ca: 0.0005-0.1%, and Al: 0.01-1%

Each of Mg, Ca, and Al is effective at improving hot workability. When they are added, the lower limit on the content for providing these effects is at least 0.0005% for Mg and Ca and at least 0.01% for Al. However, addition of too much decreases weldability, so the upper limits are 0.1% for Mg and Ca and 1% for Al. Preferred ranges are 0.0008-0.05% for Mg and Ca and 0.01-0.6% for Al.

At least one of Y and Ln series elements: 0.005-0.15%

Y and Ln series elements are effective at increasing oxidation resistance, so a stainless steel according to the present invention may include Y and/or one or more Ln series elements. The effects thereof are not obtained with less than 0.005% of any of these which is added, while excessive addition worsens workability, so the upper limit for each is made 0.15%. Of Ln series elements, it is particularly preferred to use one or more of La, Ce, and Nd. The Ln series refers to the elements La (atomic number 57) through Lu (atomic number 71) on the periodic table.

At least one of Pd: 0.005-1%, Ag: 0.005-1%, Pt: 0.005-1%, and Au: 0.005-1%

Each of Pd, Ag, Pt, and Au can be added with the object of increasing corrosion resistance. The effect thereof cannot be obtained with less than 0.005% of any one which is added, whereas addition of more than 1% decreases workability and leads to an increase in costs, so the upper limit for each is made 1%. The preferred range for any of Pd, Ag, Pt, and Au which is added is 0.005-0.5%.

Although both the inner and outer surfaces of a stainless steel pipe according to the present invention may have the ability to form and regenerate a scale layer which shields against carburizing gas, typically only the inner surface of the pipe is exposed to carburizing gas during use. Therefore, in most situations, it is sufficient if just the inner surface of the pipe has the ability to form and regenerate a scale layer which shields against carburizing gas.

A stainless steel according to the present invention can be formed into a pipe by conventional methods used for pipe manufacture, including steps such as melting, casting, hot working, cold working, and welding. It may be either a seamless pipe or a welded pipe. It can also be formed into a pipe by methods such as powder metallurgy methods or centrifugal casting. The manufacturing method will typically include final heat treatment which produces a Cr concentration of the Cr-depleted zone of at least 10%. After final heat treatment is carried out, surface treatment such as pickling, shot blasting, machining, grinding, and electropolishing may be carried out on the surface of the steel pipe.

Formation of oxide scale layers (A) and (B) is carried out at the time of the final heat treatment. The desired oxide scale layers result from a suitable combination of the steel composition and the heat treatment conditions, as will be readily understood by those skilled in the art from the proceeding explanation.

EXAMPLES

The present invention will be described in greater detail by the following examples, which are meant to be illustrative and do not limit the scope of the present invention.

Steels having the chemical compositions shown in Table 1 were melted in a high frequency vacuum heating furnace and formed into billets. The resulting billets were subjected to hot forging and cold rolling to prepare steel pipes with an outer diameter of 56 mm and a wall thickness of 6 mm. Each steel pipe underwent heat treatment under one of the four heat treatment conditions A-B described below. After heat treatment, the steel pipes were cut open, and some of the pipes were subjected to surface treatment in the form of shot blasting, pickling, or machining, while the remaining pipes were left in an as heat treated condition. For steel numbers 1-3 and 24 in Table 1, for each of the heat treatment conditions, heat treatment was carried out at 1200° C. for 10 minutes. For steel numbers 4-23, heat treatment was carried out using heat treatment condition A while varying the heat treatment temperature in the range of 1000-1250° C. and varying the heat treatment time in the range of 1 minute to 1 hour.

Heat Treatment Condition A:

vacuum heat treatment (1000-1250° C.) for 1 minute to 1 hour

Heat Treatment Condition B:

heat treatment in a gas containing 20 vol % $H_2O$ (1050-1250° C.) for 1 minute to 1 hour Heat treatment condition C:

two-step heat treatment (heat treatment condition A+heat treatment condition B)

Heat treatment condition D:

two-step heat treatment (heat treatment condition B+heat treatment condition A)

Test pieces measuring 20 mm on a side (20 mm×20 mm×6 mm) were cut from the steel pipes which were subjected to the surface treatment, the test pieces were worked to prepare test pieces for observation of the cross section, and the Cr concentration in the Cr-depleted zone and the thickness of the Cr-depleted zone were measured with EPMA (Electron Probe Micro-Analysis). For the "as heat treated" steel pipes which did not undergo surface treatment, an oxide scale layer remained on the steel surface, so the Cr content of the oxide scale layer and the thickness of the oxide scale layer were measured by EDX and a light microscope, respectively, and the Cr concentration and thickness of the Cr-depleted zone were measured by the same method as for the steel pipes which underwent surface treatment.

The results are compiled in Table 2.

Test pieces having a width of 20 mm and a length of 30 mm were cut from steel pipes which underwent the same heat treatment and surface treatment as the test pieces described with respect to Table 2. These test pieces were held for 300 hours at 1000° C. in a gas atmosphere containing, in volume %, 15% $CH_4$-3% $CO_2$-82% $H_2$ and a test of coking properties was carried out. Coking properties were evaluated based on the amount of C which penetrated the base metal after holding in the above-described gas atmosphere. Namely, metal cuttings were obtained from the test pieces at a pitch of 5 mm in the depth direction from the surface, and the amount of C (mass %) at a depth of 0.5-1.0 mm and a depth of 1.0-1.5 mm was measured by chemical analysis of the metal cuttings. After the amount of C in the base metal (mass %) prior to the test was subtracted, the average value of both amounts of C was made the amount of C (mass %) which penetrated to a depth of 1 mm.

The results are compiled in Table 3.

As shown in Table 3, a steel pipe of steel number 24 for which the chemical composition was outside the range of the present invention had a large amount of penetration of C and a large amount of surface accumulation of C for both heat treatment condition A and B, and its resistance to carburization and resistance to coking were both poor.

As also shown in Table 3, of the steel pipes made of steels number 1-38 which satisfied the chemical composition set forth in the present invention, those which satisfied the requirements for the Cr concentration and the thickness of the Cr-depleted zone according to the present invention had an extremely small amount of penetrated C and surface accumulation of C, and the resistance to carburization and resistance to coking were excellent, but for the steel pipes of the steel numbers which did not satisfy one or both of the conditions of the present invention for the Cr concentration and the thickness of the Cr-depleted zone, the amount of penetration of C and the amount of surface accumulation of C were large, and the resistance to carburization and the resistance to coking were inferior.

TABLE 1

| Steel | Chemical composition of base metal (mass %) | | | | | | | | | |
|---|---|---|---|---|---|---|---|---|---|---|
| No. | C | Si | Mn | P | S | Cr | Ni | N | Oxygen | Others |
| 1 | 0.21 | 0.36 | 0.42 | 0.020 | <0.001 | 25.8 | 24.5 | 0.04 | 0.010 | 0.5Ti |
| 2 | 0.11 | 1.67 | 0.28 | 0.017 | <0.001 | 25.3 | 38.3 | 0.02 | 0.010 | 1.2Mo |
| 3 | 0.08 | 0.35 | 1.20 | 0.025 | <0.001 | 20.7 | 30.5 | 0.02 | 0.003 | 0.004Ca |
| 4 | 0.11 | 0.87 | 0.55 | 0.035 | 0.035 | 26.4 | 37.9 | 0.02 | 0.017 | 2.9Co |
| 5 | 0.06 | 1.67 | 0.34 | 0.018 | <0.001 | 25.3 | 37.6 | 0.21 | 0.004 | 0.034Ce |
| 6 | 0.13 | 0.54 | 0.66 | 0.021 | 0.001 | 26.4 | 34.2 | 0.03 | 0.009 | 0.12Al |
| 7 | 0.04 | 3.55 | 0.44 | 0.015 | 0.001 | 24.8 | 33.8 | 0.04 | 0.005 | 0.02Zr, 0.3Ti |
| 8 | 0.16 | 1.11 | 0.84 | 0.065 | <0.001 | 26.7 | 38.5 | 0.02 | 0.005 | 0.025Y |
| 9 | 0.06 | 0.85 | 0.77 | 0.018 | 0.001 | 22.5 | 23.5 | 0.02 | 0.010 | — |
| 10 | 0.08 | 1.45 | 1.35 | 0.025 | 0.002 | 23.8 | 46.5 | 0.03 | 0.010 | 3.5W |
| 11 | 0.13 | 0.32 | 0.16 | 0.024 | 0.002 | 23.8 | 36.4 | 0.13 | 0.006 | 2.5Cu |
| 12 | 0.11 | 1.85 | 3.20 | 0.022 | 0.001 | 28.9 | 42.5 | 0.05 | 0.015 | 1.3Nb |
| 13 | 0.01 | 0.12 | 0.15 | 0.018 | <0.001 | 31.2 | 60.8 | 0.01 | 0.005 | 0.029La |
| 14 | 0.07 | 0.55 | 0.32 | 0.030 | 0.003 | 26.1 | 40.1 | 0.03 | 0.010 | 0.2W, 0.3Mo |
| 15 | 0.04 | 1.59 | 0.28 | 0.027 | 0.001 | 24.2 | 43.1 | 0.06 | 0.010 | 0.008 B |
| 16 | 0.32 | 0.16 | 0.88 | 0.042 | 0.027 | 23.1 | 32.1 | 0.01 | 0.007 | 0.06Zr |
| 17 | 0.09 | 0.57 | 0.59 | 0.049 | 0.001 | 24.6 | 35.8 | 0.01 | 0.007 | 0.05Hf |
| 18 | 0.11 | 1.12 | 0.24 | 0.022 | 0.005 | 22.1 | 32.5 | 0.03 | 0.007 | 0.004Mg |
| 19 | 0.02 | 1.33 | 1.09 | 0.029 | 0.011 | 23.9 | 36.8 | 0.02 | 0.010 | 0.041Nd |
| 20 | 0.10 | 1.13 | 0.89 | 0.030 | 0.021 | 24.0 | 40.8 | 0.01 | 0.015 | 0.2Cu, 1.2Co |
| 21 | 0.09 | 1.25 | 1.20 | 0.009 | 0.003 | 25.2 | 33.5 | 0.03 | 0.010 | 1.4Cu, 0.13Nd |
| 22 | 0.06 | 1.34 | 0.43 | 0.021 | 0.002 | 25.3 | 40.3 | 0.03 | 0.010 | 2.5Co, 2.8W |
| 23 | 0.01 | 1.35 | 1.31 | 0.029 | 0.009 | 22.8 | 39.5 | 0.02 | 0.005 | 3.1Cu, 0.59Co, 0.9Mo |

TABLE 1-continued

| Steel | Chemical composition of base metal (mass %) | | | | | | | | | |
|---|---|---|---|---|---|---|---|---|---|---|
| No. | C | Si | Mn | P | S | Cr | Ni | N | Oxygen | Others |
| | | | | | | | | | | 0.4Ti, 0.018B, 0.010Mg, 0.031Y |
| 24 | 0.11 | 0.46 | 1.31 | 0.025 | 0.001 | 18.6 | 25.5 | 0.03 | 0.010 | — |
| 25 | 0.07 | 0.51 | 0.39 | 0.015 | 0.001 | 25.0 | 34.5 | 0.04 | 0.010 | 0.5Ti, 0.5Al, 0.4Re |
| 26 | 0.05 | 1.64 | 1.51 | 0.015 | 0.001 | 25.3 | 35.5 | 0.16 | 0.010 | 0.05Ce, 0.02Pd |
| 27 | 0.45 | 1.82 | 1.10 | 0.021 | 0.002 | 31.5 | 44.2 | 0.02 | 0.015 | 1.13Nb, 0.1Pt |
| 28 | 0.47 | 1.78 | 1.15 | 0.020 | 0.002 | 26.1 | 35.4 | 0.03 | 0.013 | 0.7Nb, 0.31r |
| 29 | 0.09 | 1.81 | 0.51 | 0.015 | 0.001 | 25.3 | 42.1 | 0.01 | 0.007 | 0.2Ti, 0.4Nb, 0.2Ta 0.1Ag |
| 30 | 0.25 | 0.48 | 0.28 | 0.021 | 0.001 | 44.8 | 52.1 | 0.01 | 0.011 | — |
| 31 | 0.07 | 1.57 | 1.12 | 0.022 | 0.001 | 23.5 | 35.8 | 0.03 | 0.008 | 0.12Au |
| 32 | 0.12 | 0.15 | 0.22 | 0.015 | 0.001 | 23.7 | 45.1 | 0.02 | 0.005 | 0.9Al, 0.03Pr |
| 33 | 0.06 | 1.54 | 0.32 | 0.008 | 0.001 | 28.9 | 57.6 | 0.01 | 0.009 | 1.3Ta |
| 34 | 0.08 | 1.67 | 0.45 | 0.011 | 0.001 | 24.2 | 38.7 | 0.02 | 0.004 | 1.1Re |
| 35 | 0.12 | 1.27 | 0.67 | 0.009 | 0.002 | 23.1 | 36.7 | 0.02 | 0.008 | 0.8Ir |
| 36 | 0.15 | 1.81 | 0.11 | 0.015 | 0.001 | 22.8 | 37.1 | 0.01 | 0.004 | 0.3Pd |
| 37 | 0.11 | 1.38 | 0.71 | 0.019 | 0.002 | 26.4 | 34.9 | 0.02 | 0.007 | 0.2Ag |
| 38 | 0.15 | 0.87 | 0.38 | 0.024 | 0.001 | 27.1 | 39.1 | 0.02 | 0.004 | 0.3Pt |

Underlining indicates a value outside the range of the present invention

TABLE 2

| | | | Cr-depleted zone | | Oxide scale layer (A) | | Oxide scale layer (B) | |
|---|---|---|---|---|---|---|---|---|
| Steel No. | heat treatment condition | Surface treatment | Cr concentration (mass %) | Depth (μm) | Cr content (mass %) | Thick-ness (μm) | Si content (mass %) | Thick-ness (μm) |
| 1 | A | shot blasting | 14.7 | 10 | — | — | — | — |
| | B | shot blasting | 9.4 | 12 | — | — | — | — |
| 2 | A | as heat treated | 16.2 | 10 | 96 | 4 | 80 | 0.5 |
| | B | as heat treated | 18.7 | 24 | 90 | 6 | 80 | 0.5 |
| | C | as heat treated | 13.1 | 8 | 74 | 9 | 85 | 0.8 |
| | D | as heat treated | 14.5 | 18 | 82 | 17 | 75 | 0.5 |
| 3 | A | as heat treated | 10.9 | 14 | 82 | 9 | 55 | 0.4 |
| | B | as heat treated | 6.8 | 22 | 80 | 13 | 75 | 0.7 |
| | C | shot blasting | 12.1 | 10 | — | — | — | — |
| | D | shot blasting | 7.8 | 10 | — | — | — | — |
| 4 | A | shot blasting | 18.3 | 8 | — | — | — | — |
| 5 | A | pickling | 17.3 | 5 | — | — | — | — |
| 6 | A | as heat treated | 15.5 | 15 | 92 | 9 | 50 | 0.3 |
| 7 | A | pickling | 21.4 | 4 | — | — | — | — |
| 8 | A | shot blasting | 24.6 | 10 | — | — | — | — |
| 9 | A | pickling | 17.8 | 10 | — | — | — | — |
| 10 | A | machining | 20.9 | 2 | — | — | — | — |
| 11 | A | as heat treated | 14.2 | 12 | 90 | 7 | 30 | 0.3 |
| 12 | A | shot blasting | 26.8 | 3 | — | — | — | — |
| 13 | A | pickling | 24.5 | 5 | — | — | — | — |
| 14 | A | shot blasting | 20.5 | 7 | — | — | — | — |
| 15 | A | as heat treated | 14.6 | 9 | 93 | 4 | 80 | 0.4 |
| 16 | A | machining | 21.5 | 5 | — | — | — | — |
| 17 | A | pickling | 21.4 | 4 | — | — | — | — |
| 18 | A | pickling | 18.6 | 5 | — | — | — | — |
| 19 | A | shot blasting | 20.2 | 5 | — | — | — | — |
| 20 | A | as heat treated | 15.6 | 6 | 80 | 9 | 75 | 0.5 |
| 21 | A | as heat treated | 13.8 | 8 | 80 | 10 | 95 | 0.8 |
| 22 | A | as heat treated | 18.1 | 5 | 90 | 7 | 90 | 0.7 |
| 23 | A | as heat treated | 12.5 | 10 | 75 | 12 | 90 | 0.8 |
| 24 | A | as heat treated | 6.2 | 14 | 73 | 12 | 40 | 0.5 |
| | B | shot blasting | 8.9 | 7 | — | — | — | — |
| 25 | A | as heat treated | 16.2 | 10 | 75 | 11 | 30 | 0.2 |
| 26 | A | as heat treated | 16.4 | 12 | 90 | 8 | 90 | 0.6 |
| 27 | A | as heat treated | 21.5 | 12 | 88 | 8 | 90 | 0.7 |
| 28 | A | as heat treated | 17.2 | 11 | 85 | 7 | 90 | 0.6 |
| 29 | A | as heat treated | 15.4 | 14 | 85 | 9 | 90 | 0.5 |
| 30 | A | as heat treated | 27.5 | 16 | 95 | 8 | 30 | 0.4 |
| 31 | A | as heat treated | 15.8 | 10 | 88 | 8 | 90 | 0.7 |
| 32 | A | as heat treated | 18.6 | 10 | 70 | 6 | — | — |
| 33 | A | as heat treated | 22.3 | 10 | 93 | 6 | 80 | 0.5 |
| 34 | A | as heat treated | 15.1 | 10 | 80 | 8 | 80 | 0.6 |
| 35 | A | as heat treated | 13.0 | 16 | 74 | 10 | 75 | 0.4 |

TABLE 2-continued

| Steel No. | heat treatment condition | Surface treatment | Cr-depleted zone: Cr concentration (mass %) | Cr-depleted zone: Depth (μm) | Oxide scale layer (A): Cr content (mass %) | Oxide scale layer (A): Thickness (μm) | Oxide scale layer (B): Si content (mass %) | Oxide scale layer (B): Thickness (μm) |
|---|---|---|---|---|---|---|---|---|
| 36 | A | as heat treated | 11.8 | 17 | 75 | 10 | 90 | 0.6 |
| 37 | A | as heat treated | 14.8 | 11 | 80 | 8 | 70 | 0.3 |
| 38 | A | as heat treated | 18.9 | 13 | 93 | 9 | 50 | 0.7 |

Underlining indicates a value outside the ragge of the present invention

TABLE 3

| Steel No. | Heat treatment condition | Increase in C content (mass %) | Amount of coke deposition ($mg/cm^2$) |
|---|---|---|---|
| 1 | A | 0.9 | 1.8 |
| | B | 2.2 | 8.9 |
| 2 | A | 0.6 | 1.0 |
| | B | 1.7 | 6.2 |
| | C | 0.9 | 1.2 |
| | D | 0.9 | 1.3 |
| 3 | A | 1.1 | 1.9 |
| | B | 2.8 | 12.5 |
| | C | 1.2 | 1.5 |
| | D | 2.7 | 9.7 |
| 4 | A | 0.6 | 0.5 |
| 5 | A | 0.4 | 0.5 |
| 6 | A | 0.8 | 1.5 |
| 7 | A | 0.3 | 0.8 |
| 8 | A | 0.45 | 0.5 |
| 9 | A | 1.2 | 1.7 |
| 10 | A | 0.6 | 0.6 |
| 11 | A | 1.4 | 2.3 |
| 12 | A | 0.4 | 0.3 |
| 13 | A | 0.5 | 0.6 |
| 14 | A | 0.7 | 0.9 |
| 15 | A | 0.8 | 0.6 |
| 16 | A | 0.7 | 0.6 |
| 17 | A | 1.4 | 1.3 |
| 18 | A | 0.6 | 0.6 |
| 19 | A | 0.55 | 0.6 |
| 20 | A | 0.6 | 0.3 |
| 21 | A | 0.9 | 0.9 |
| 22 | A | 0.4 | 0.2 |
| 23 | A | 1.2 | 1.3 |
| 24 | A | 3.3 | 15.3 |
| | B | 3.4 | 12.4 |
| 25 | A | 1.3 | 1.5 |
| 26 | A | 0.9 | 0.8 |
| 27 | A | 0.5 | 0.3 |
| 28 | A | 0.9 | 0.8 |
| 29 | A | 0.7 | 0.6 |
| 30 | A | 0.5 | 0.2 |
| 31 | A | 0.8 | 0.6 |
| 32 | A | 0.4 | 0.4 |
| 33 | A | 0.4 | 0.4 |
| 34 | A | 0.6 | 0.5 |
| 35 | A | 1.3 | 1.2 |
| 36 | A | 1.1 | 0.8 |
| 37 | A | 0.8 | 0.8 |
| 38 | A | 0.7 | 0.6 |

Underlining indicates a value outside the range of the present invention

As described above, a steel according to the present invention has the ability to form and regenerate a surface scale layer which shields against carburizing gas, and it has excellent resistance to carburization and coking, so pipes made from this steel can be used in cracking furnaces, reforming furnaces, heating furnaces, piping, and heat exchangers in petroleum refineries and petrochemical plants. Therefore, the pipes can greatly increase the durability and the operating efficiency of equipment.

What is claimed is:

1. A Ni—Cr—Fe alloy for use in a carburizing gas atmosphere comprising a base metal having a chemical composition comprising in mass %, C: 0.01-0.6%, Si: 0.1-5%, Mn: 0.1-10%, P: at most 0.08%, S: at most 0.05%, Cr: 22-55%, Ni: 23-70%, N: 0.001-0.25%, O: oxygen: at most 0.02%, and a remainder of Fe and impurities, the base metal having in its surface region a Cr-depleted zone with a Cr concentration of at least 10 mass % but less than a concentration of Cr in the base metal, and a thickness of at most 20 micrometers, said surface of the base metal formed by removing an oxide scale generated by heating of the base metal.

2. A Ni—Cr—Fe alloy as claimed in claim 1 wherein the base metal further comprises, in mass percent, at least one material selected from the following (i)-(viii)

(i) Cu: 0.01-5%, (ii) Co: 0.01-5%

(iii) at least one of Mo: 0.01-3%, W: 0.01-6%, Ta: 0.01-6%, Re: 0.01-6%, and Ir: 0.01-6%

(iv) at least one of Ti: 0.01-1% and Nb: 0.01-2%

(v) at least one of B: 0.001-0.1%, Zr: 0.001-0.1%, and Hf: 0.001-0.5%

(vi) at least one of Mg: 0.0005-0.1%, Ca: 0.0005-0.1%, and Al: 0.01-1%

(vii) at least one of Y: 0.0005-0.15%, and Ln series elements: 0.0005-0.15%

(viii) at least one of Pd: 0.005-1%, Ag: 0.005-1%, Pt: 0.005-1%, and Au: 0.005-1%.

3. An alloy pipe comprising a Ni—Cr—Fe alloy as claimed in claim 2 and having surface irregularities on the inner surface of the pipe.

4. An alloy pipe comprising a Ni—Cr—Fe as claimed in claim 1 and having surface irregularities on the inner surface of the pipe.

5. A Ni—Cr—Fe alloy for use in a carburizing gas atmosphere comprising a base metal having a chemical composition comprising in mass %, C: 0.01-0.6%, Si: 0.1-5%, Mn: 0.1-10%, P: at most 0.08%, S: at most 0.05%, Cr: 22-55%, Ni: 23-70%, N: 0.001-0.25%, O: oxygen: at most 0.02%, and a reminder of Fe and impurities, the base metal having in its surface region a Cr-depleted zone with a Cr concentration of at least 10 mass % but less than a concentration of Cr in the base metal, and a thickness of at most 20 micrometers, said base metal further including a Cr-based oxide scale layer with a Cr content of at least 50 mass % on the outer side of the Cr-depleted zone, wherein the Cr-based oxide scale layer has a thickness of 0.1-15 micrometers.

6. A Ni—Cr—Fe alloy as claimed in claim 1, including an Si-based oxide scale layer with an Si content of at least 50 mass % between the Cr-based oxide scale layer and the Cr-depleted zone.

7. An alloy pipe comprising a Ni—Cr—Fe alloy as claimed in claim 6 and having surface irregularities on the inner surface of the pipe.

8. A Ni—Cr—Fe alloy as claimed in claim 6, where in the base metal further comprises, in mass percent, at least one material selected from the following (i)-(viii)

(i) Cu: 0.01-5%, (ii) Co: 0.01-5%, (iii) at least one of Mo: 0.1-3%, W; 0.01-6%, Ta: 0.01-6%, Re: 0.01-6%, and Ir: 0.01-6%, (iv) at least one of Ti: 0.01-1% and Nb: 0.01-2%, (v) at least one of B: 0.001-0.1%, Sr: 0.001-0.1%, and Hf: 0.001-0.5%, (vi) at least one of Mg: 0.0005-0.1%, Ca: 0.0005-0.1% and Al: 0.01-1%, (vii) at least one of Y: 0.0005-0.15%, and Ln series elements: 0.0005-0.15%, (viii) at least one of Pd: 0.005-1%, Ag: 0.005-1%, Pt: 0.005-1%, and Au: 0.005-1%.

9. An alloy pipe comprising a Ni—Cr—Fe alloy as claimed in claim 8 and having surface irregularities on the inner surface of the pipe.

10. An alloy pipe comprising a Ni—Cr—Fe alloy as claimed in claim 5 and having surface irregularities on the inner surface of the pipe.

11. A Ni—Cr—Fe alloy as claimed in claim 5, where in the base metal further comprises, in mass percent, at least one material selected from the following (i)-(viii)

(i) Cu: 0.01-5%, (ii) Co: 0.0 1-5%, (iii) at least one of Mo: 0.1-3%, W; 0.01-6%, Ta: 0.01-6%, Re: 0.01-6%, and Ir: 0.01-6%

(iv) at least one of Ti: 0.01-1% and Nb: 0.01-2%, (v) at least one of B: 0.001-0.1%, Sr: 0.001-0.1%, and Hf: 0.001-0.5%, (vi) at least one of Mg: 0.0005-0.1%, Ca: 0.0005-0.1% and Al: 0.01-1%, (vii) at least one of Y: 0.0005-0.15%, and Ln series elements: 0.0005-0.15%, (viii) at least one of Pd: 0.005-1%, Ag: 0.005-1%, Pt: 0.005-1%, and Au: 0.005-1%.

12. An alloy pipe comprising a Ni—Cr—Fe alloy as claimed in claim 11 and having surface irregularities on the inner surface of the pipe.

* * * * *